US009200456B2

(12) United States Patent
Murphy

(10) Patent No.: US 9,200,456 B2
(45) Date of Patent: Dec. 1, 2015

(54) JOINER CLIP

(71) Applicant: TRINITY ERD, Seattle, WA (US)

(72) Inventor: Colin R. Murphy, Seattle, WA (US)

(73) Assignee: EXTERIOR RESEARCH & DESIGN LLC, Seattle, WA (US)

( * ) Notice: Subject to any disclaimer, the term of this patent is extended or adjusted under 35 U.S.C. 154(b) by 24 days.

(21) Appl. No.: 13/940,855

(22) Filed: Jul. 12, 2013

(65) Prior Publication Data

US 2014/0013696 A1 Jan. 16, 2014

Related U.S. Application Data

(60) Provisional application No. 61/670,863, filed on Jul. 12, 2012, provisional application No. 61/758,976, filed on Jan. 31, 2013.

(51) Int. Cl.
*E04B 2/30* (2006.01)
*E04F 13/08* (2006.01)

(52) U.S. Cl.
CPC ..... *E04F 13/0801* (2013.01); *E04F 13/0828* (2013.01); *E04F 13/0869* (2013.01)

(58) Field of Classification Search
CPC ..... E04F 13/0801; E04F 13/0869; E04F 13/0871; E04F 21/1855; E04B 2001/405; E04B 2/721; E04B 2/723
USPC ..... 52/489.1, 489.2, 522, 543, 582.1, 546, 52/553, 560
See application file for complete search history.

(56) References Cited

U.S. PATENT DOCUMENTS

| | | | | |
|---|---|---|---|---|
| 2,216,271 | A * | 10/1940 | Joiner | 52/548 |
| 4,296,580 | A * | 10/1981 | Weinar | 52/281 |
| 4,448,007 | A | 5/1984 | Adams | |
| 4,995,605 | A | 2/1991 | Conville | |
| 5,058,358 | A | 10/1991 | Stratton | |
| 5,564,245 | A | 10/1996 | Rademacher | |
| 6,367,220 | B1 | 4/2002 | Krause et al. | |
| 6,725,619 | B1 | 4/2004 | Barber | |
| 7,441,382 | B2 * | 10/2008 | Beck et al. | 52/543 |
| 7,748,187 | B2 * | 7/2010 | Sensenig | 52/489.1 |
| 2004/0074188 | A1 * | 4/2004 | Beck et al. | 52/522 |
| 2004/0237443 | A1 | 12/2004 | Haley et al. | |

* cited by examiner

*Primary Examiner* — Patrick Maestri
(74) *Attorney, Agent, or Firm* — Avery N. Goldstein; Blue Filament Law

(57) ABSTRACT

A joiner clip for securing panels to a substrate is provided that includes a planar sheet of material that has a bottom portion terminating in outer edges. A pair of legs extends downward from the outer edges and terminating in a retaining shelf clip adapted to support a bottom edge of an inserted panel. Mounting holes form countersunk indents in the planar sheet that offsets the joiner clip from the substrate. A construction unit is also provided has such a joiner clip secured to a vertical stud substrate. At least inserted panel is supported in the retaining shelf clip of a first leg of the clip. A joint is readily formed between two inserted panels. Fasteners through an inserted panel secure the same to the clip and substrate. An additional siding strip is readily secured to the substrate below the pair of legs.

18 Claims, 9 Drawing Sheets

JOINER CLIP

RELATED APPLICATIONS

This application claims priority benefit of U.S. Provisional Application Ser. 61/670,863 filed Jul. 12, 2012; and of U.S. Provisional Application Ser. 61/758,976 filed Jan. 31, 2013; the contents of which are hereby incorporated by reference.

FIELD OF THE INVENTION

The present invention in general relates to an apparatus for installing and securing panels to a frame and in particular to a joiner plate or clip designed to address framing that is not planar, and for securing thin, brittle, and fragile panels that are prone to fracture during installation.

BACKGROUND OF THE INVENTION

Frame construction is a quick and efficient method of constructing inner and outer walls in structures. Frames generally are formed with vertical members called studs that are joined to upper and lower horizontal members.

Traditionally, studs were made of wood, usually 2'×4" or 2"×6" dimensional lumber. In North America, studs are typically placed 16 inches from each other's center, but sometimes also at 12 inch or 24 inch intervals. Steel studs are gaining popularity, especially for non load-bearing walls. Typically, panels, siding or other types of wall materials and sheeting are secured to the frame via screws, nails, or other specialty fasteners to the studs. However, non-planar framing may result in stress cracks and uneven or bowed surfaces in the joined panels, siding or other wall materials.

Fiber cement (FC) siding most often includes overlapping horizontal boards, imitating wooden siding, clapboard and imitation shingles, or large panels simulating tongue and groove or board and batten applications. Fiber cement siding is also manufactured in a sheet form and is used not only as cladding but is also commonly used as a soffit/eave lining and as a tile underlay on decks and in bathrooms. Fiber cement siding is not only used as an exterior siding, it can also be utilized as a substitute for timber fascias and bargeboards, especially in high fire risk or prone areas.

Siding or cladding materials, due to the material cost or manufacturing methods, are often thin and typically brittle or fragile. The thin nature of siding and cladding materials results in the siding materials conforming to the planar conditions of the framing. This can result in building stress into the applied panel. In addition to fiber cement, thin panels may be formed from laminated and composite wood materials, and panels formed from polymer resins. Siding materials can also be formed from steel, aluminum and ultra violet light resistant polyvinyl chloride. Despite the fragile nature of the aforementioned siding materials, attachment studs with widths that typically range from between 1¼-inch to 2-inches provide a very small 'target' to match and align the butt ends of the panels formed from the siding materials. With thicker, less brittle panels, such as cedar siding, a nail or screw can be installed at an angle into the stud, minimizing the problems created by the narrow stud; however, this cannot be done consistently with thinner and brittle panels. When securing to steel studs, the screw cannot be installed at an angle. The screw must be installed perpendicular to the stud to effectively penetrate the steel stud. A screw installed at an angle will not cut or pierce the steel to penetrate the section of steel. Also, if a stud is out of alignment or the panel has been mis-cut, there is insufficient bearing for the two panels to be secured to a single stud. The problem is compounded by the thin nature of the panel and the need for the head of the fastener to be flush with the surface of the panel, which requires the use of a countersunk head screw, typically with 'burrs' or 'wings' under the head to bore into the relatively hard and brittle panel to sink the head flush with the panel surface. The boring weakens the panel at a critical point since the butt edge attachment is very close to the edge.

The problems associated with the thin and brittle nature of certain panels are compounded when attached to a series of studs in a frame that are not planer. When a stud is not planer to panel, there is additional stress as two adjoining panel members are forced into alignment, which creates stress at both panel edges of the adjoined panels. Furthermore, even if a stud is planer to the outer face, the face of the stud can be damaged creating a point of attachment that is out of plane. By loading the end of the panel and drawing the panel out of plane, the panel will, over time, likely crack due to the loads created by pushing or pulling the panel to the misaligned stud. If the butt end of the panel is supported by the stud by only a fraction of an inch (a common occurrence) the nail or screw must be installed at an angle, creating further stress on the panel and resulting in cracking. Where wood studs are used, fasteners may be installed at angles to compensate for misalignment. However, for studs that are steel or made of composite materials, fasteners must enter perpendicular to the point of attachment to allow the fastener to drill or penetrate the substrate material.

Finally, to accommodate for material expansion, panel manufacturers often require gapping of the panels of approximately ⅛-inch or moderate contact of the edges. The expansion gap between panels further reduces the area on a panel for attachment to a stud, which creates greater problems achieving an adequate surface for attachment. For a perfect 'marriage' of the butt ends, the panel ends must be cut perfectly at a ninety degree angle in the field, which is not always achieved creating a gap between the two panel edges, again reducing the target area of attachment. The reduced area available for attachment requires screw head sizes that must be smaller to minimize the area of 'boring' into the panel surface to set the screw flush. Since the screw must be a minimum distance offset from the panel edge, the size of the screw head must remain small. Typical screw head sizes are 0.330 to 0.400-inches.

Thus, there exists a need for a joiner plate or clip that assists in installing and securing panels to a frame and is designed to address framing that is not planar, and for securing fragile panels that can be fractured during installation.

SUMMARY OF THE INVENTION

A joiner clip for securing panels to a substrate is provided that includes a planar sheet of material that has a bottom portion terminating in outer edges. A pair of legs extends downward from the outer edges and terminating in a retaining shelf clip adapted to support a bottom edge of an inserted panel. Mounting holes form countersunk indents in the planar sheet that offsets the joiner clip from the substrate. A construction unit is also provided has such a joiner clip secured to a vertical stud substrate. At least inserted panel is supported in the retaining shelf clip of a first leg of the clip. A joint is readily formed between two inserted panels. Fasteners through an inserted panel secure the same to the clip and substrate. An additional siding strip is readily secured to the substrate below the pair of legs.

DETAILED DESCRIPTION OF THE PREFERRED EMBODIMENTS

Figure 1:
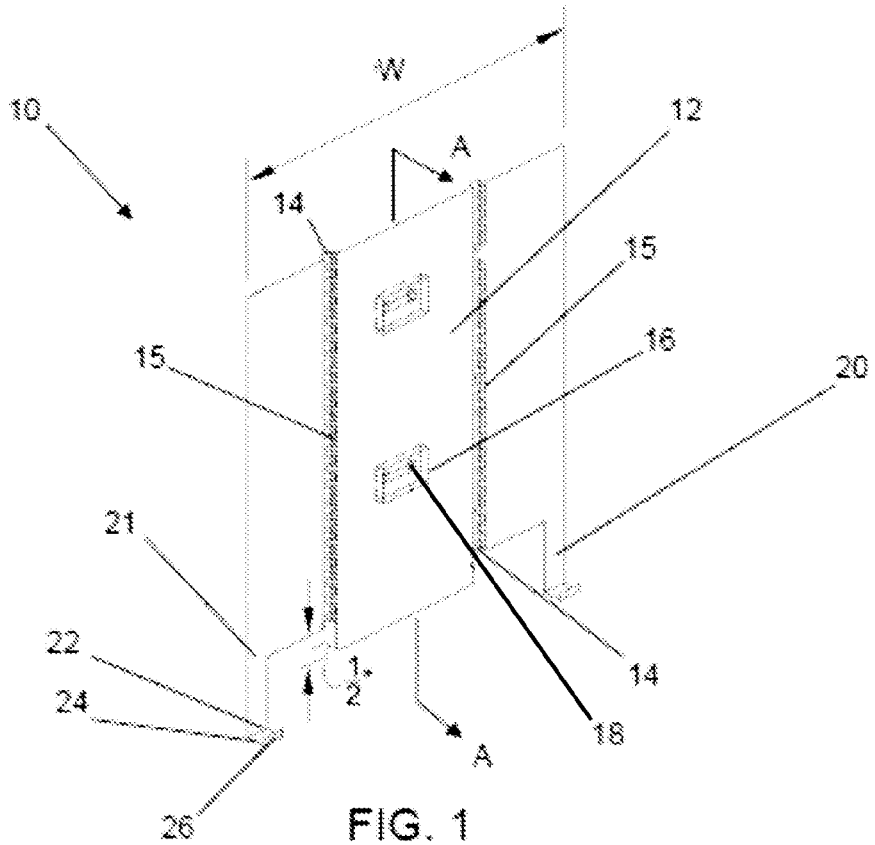
FIG. 1 is a perspective view of an embodiment of the joiner plate.

The present invention has utility as a joiner clip to form a construction unit that assists in installing and securing panels to a frame and is designed to address framing that is not planar, as well address issues related to securing fragile panels that can be fractured during installation. As used herein, the terms "joiner plate" and "joiner clip" are used synonymously. Embodiments of the inventive joiner plate or clip increase speed in panel or siding installation by minimizing re-cutting due to variations in studs and provides for a bearing surface to receive sealant beads to enhance bonding of the cladding panels and to direct waterflow at the panel joints to the outer face of the cladding. In certain embodiments, an extended lip at the bottom of the joiner plate eliminates the need for a flashing membrane or flat metal plate behind a panel edge joint to direct any incidental water that enters the joint to a building exterior. Embodiments of the inventive joiner plate may be used for substrates such as wood, metal, alloy, and steel studs.

It is to be understood that in instances where a range of values are provided that the range is intended to encompass not only the end point values of the range but also intermediate values of the range as explicitly being included within the range and varying by the last significant figure of the range. By way of example, a recited range of from 1 to 4 is intended to include 1-2, 1-3, 2-4, 3-4, and 1-4.

Embodiments of the on-stud attachment joiner plate or clip provide for even support of panels with a broad attachment base. Embodiments of the on stud attachment joiner plate or clip are an improvement over existing off-stud joiners that slip on a panel below and only provide approximate 2 to 2½-inch bearing surface for attachment of a panel. The broad attachment base allows for a reduction in the number of joiner plates or hangers for a given length of panel, thereby requiring less labor and installation time. The broad attachment base provided by embodiments of the inventive joiner, in contrast to the thinner attachment surface of a traditional stud, allows for an increased screw head size (versus traditional sizes in the range of 0.330 to 0.400-inches). A pancake head screw with a head diameter of 0.450 to 0.700-inch can be used without the requirement to bore the panel surface to create a flush installation. The larger screw head creates greater holding power (rupture over the panel) and a greater wind load resistance with a single fastener. The reduction in the number of screw fasteners contributes to less potential damage to the panel, and saves time and labor with less fastening. The joint between the joiner plate and panel is fully supported to eliminate stress and cracking at the panel connection point, while also providing adequate securement to meet any wind load requirements.

The inventive joiner plate acting as an attachment or bearing plate for panels can be attached to a stud with one or two screws, depending on the size of the panels and the wind load requirements for the project. From an aesthetic point of view, the larger area of attachment also allows the installer to create an even pattern of joiner plate attachments instead of forcing fasteners in at the corners that are not pleasing.

Furthermore, the broad attachment area of the inventive joiner plate allows for screws or other fasteners to always be installed perpendicular to the joiner plate steel. The screw will enter the joiner plate without skidding, and will create maximum holding power while not stressing the panel. Attachment at extreme edges of the panel that weakens the panel with traditional studs is eliminated with the inventive joiner.

The joiner plate provides a bottom-supported connection with tabs for panels that aligns the panel both horizontally and vertically. The panel is properly aligned, vertically, by the support tabs at the bottom of the joiner plate and a 'drip lip' alignment tab that rests on the top of the panel below. The drip lip aligns the panel and acts as a drip over the panel below. The drip lip also secures the top of the panel providing additional wind resistance. The tabs perfectly align the panels and assist to hold the panel in place prior to attachment of the panel to the plate. The somewhat flexible tabs will, once the screw penetrates the steel of the plate, draw the panel to the plate and the joiner plate to the panel. This assists in reducing stress when a stud is out of alignment and creates a larger bearing surface at the back of the panel to create greater support.

The flat face of the joiner plate creates an excellent surface to mate the two panel edges. The outer edges and surfaces of the joined panels will always be in plane, eliminating shadow lines, voids, and out of plane edges. The joining plate can be formed in various sizes to address any size lap panel with any predetermined overlap. The joining plate can also be used in flat panel siding to create a bearing surface at the transition of four separate panel corners. Embodiments of the joining plate can also be modified at panel siding to accommodate reveals and gapped panels. The joining plate can be pre-colored to match pre-painted siding, or can be formed from paint grip or bonderized metal that will easily take paint. The gauge or thickness of joiner plate can be reduced by adding stiffening ribs running perpendicular with the studs.

Embodiments of the joiner plate can adjust to accommodate minor planar stud deviations in the frame support with 'control drive' fins formed on the back of the planar portion of the joiner plate, which allow an installer to set the depth of the on-stud attachment joiner plate to maintain a planar condition at the finished side of the attached panels or siding. The back fins at point of attachment to the stud allow for a controlled drive. The joining plate can be offset to compensate for a stud that is out of plane. This coupled with the flexible control drive fins of the plate provide substantial compensation for a stud out of plane. The correction of minor stud deviations reduces load protection and therefore stress on attached panels such as cement panels. The joiner plate does not need to be perfectly aligned on the stud, since the large bearing surface creates room for adjustment. Attachment of the joiner plate is low enough to avoid interference with the upper panel. Furthermore, embodiments of the joiner plate are thin enough to 'move' to create a snug connection with panels including fiber cement, yet strong enough to transfer the load through the fastener to the steel or wood stud, thereby creating an immediate correction. The use of pancake head screws to secure embodiments of the joiner plate improves attachment with a larger bearing surface since the screws can be placed lower on the joiner plate and away from edges of the plate. The pre-alignment options of embodiments of the joiner plate speed installation of the attached panels or siding.

Embodiments of the inventive joiner plate may also have provisions for joint flashing, providing weather proofing of the joint. In an embodiment, the joiner plate or clip acts as waterproofing flashing at joints of panels formed from a fabric flashing or a flat metal plate. In some embodiments, sealant channels create additional weather proofing and additional securement at the panel or siding attachment interface when the sealant is also an adhesive. The sealant channels can be arranged to be at the points of attachment, which will seal the fastener opening. The sealant channels in the joiner plate create a sealing line, keeping any water that enters the butt joint of a secured panel from traveling to a lower panel top edge or to a weather resistive barrier. Sealant may be pre-applied as a sealant strip with release paper to protect the bonding surface to speed installation. The back of the joining plate can be thermally broken to minimize thermal transfer through the plate. The sealant may also be used as an adhesive to eliminate nails or screws. Since the cladding or siding has been locked into the tabs providing alignment or support the cladding or siding can be adhered to the joiner plate creating a larger, more effective form of attachment without point loading.

Embodiments of the joiner plates or clips may also be installed at each stud, providing support for the cladding or siding from below and again at the top, securing the top edge with the drip lip. No fasteners are required through the cladding or siding at any point. The cladding or siding is secured by support of the tabs below, compression of the flashing tab and the sealant applied in the sealant channels as a sealant bead.

Figure 5:
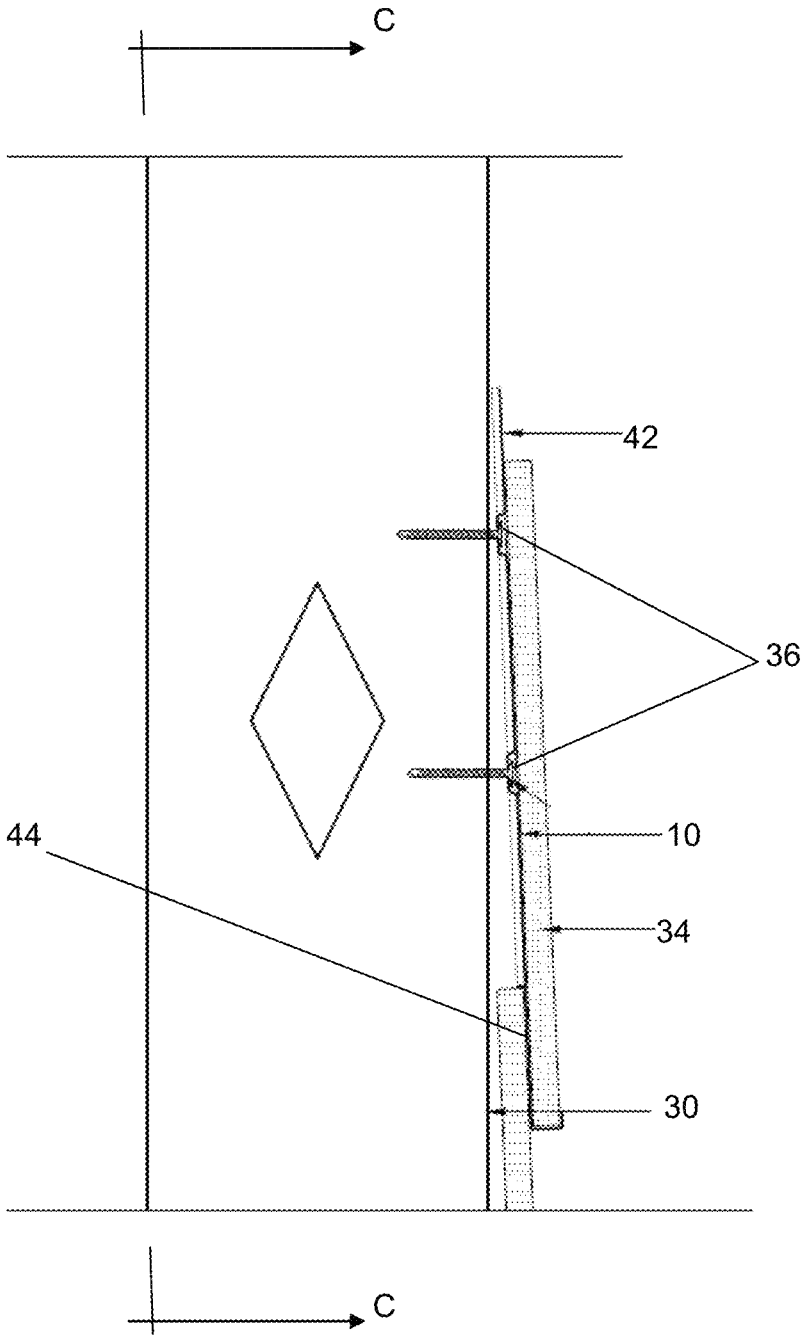
FIG. 5 is a sectional view of the embodiment of the joiner plate of FIG. 4 along line C-C showing pancake head fasteners securing the plate to a stud.

With reference to the attached figures, an inventive joiner plate or clip is depicted generally at 10 in FIG. 1. The joiner plate 10 is typically formed from a planar sheet composed of metal; metal alloys; plastic; fiber reinforced resins of fiberglass or carbon fiber; or other composite materials. In an embodiment the joiner plate 10 may be formed from 16 gauge to 26 gauge, G-90 galvanized or 55% Aluminum-Zinc alloy coated sheet steel known as GALVALUME® metal, or 16 gauge to 26 gauge galvanized paintgrip/bonderized for painting of the joiner plate surface. The joiner plate 10 has a flat face 12 in which channels 14 for holding an optional sealant or an adhesive based sealant beads 15 are formed. Mounting holes 16 are pressed into the flat face 12 with the excess material forming vertical indent tabs in the form of control drive fins 18. The control drive fins 18 are adjustable to create planar conditions for attaching panels in the event the studs are uneven. In an installation, as a screw is driven into the flat face 12 (see FIG. 5), the control drive fins determine how tight the joiner plate 10 is held to the stud 30. In an embodiment, the control drive fins 18 are a quarter of an inch (0.25 inch) length, thereby providing the ability to adjust up to 0.25 inch for correcting for the relative planarity between the studs. As shown in FIG. 5, screws 36 may be pre-set in the mounting holes 16. In an inventive embodiment, number ten (#10) pancake head screws are countersunk and flush with the vertical flat face 12 of the joiner plate 10, where the head of the screws 36 have approximately the same outer diameter as the mounting holes 16. The (#10 or #12) pancake head screws provide a minimum withdrawal resistance in 33 KSI 24 ga. galvanized steel of not less than 2251bf.

Figure 2:
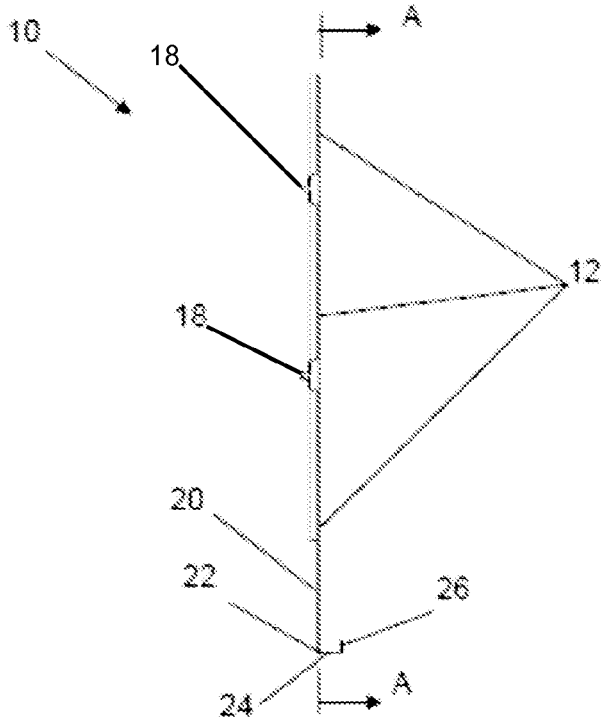
FIG. 2 is a schematic diagram illustrating a cross sectional view of the embodiment of the joiner plate of FIG. 1 along line A-A.

Continuing with FIGS. 1 and 2, the lower portion 21 of the joiner plate 10 has a pair of forward facing legs 20 extending down on the right and left sides of the joiner. Forward facing legs 20 has a fold 22 that abuts a perpendicular segment 24. It is appreciated that the legs 20 are integral with the plate 10 or formed separately and subsequently joined thereto. While the legs 20 are depicted as a pair with each positioned proximal to a lower corner edge of the joiner plate 10, it is appreciated that one or more intermediate legs are providing in the space between these bounding legs 20 so depicted. Perpendicular segment 24 terminated in lip segment 26 acts as a retaining shelf for a panel. Thus the joiner plate 10 supports a panel with both concealed screws 36 and the retaining shelf acting as a "turn-up" support clip or tab at the base of the joiner plate 10. The tabs provide support and align the fiber cement panels. The exterior or exposed face of tabs that appear as lip segment 26 are large enough to support the siding, but small enough so that the lips 26 are not easily seen. The overall width (W) of the joiner plate 10 as shown in FIG. 1 may range between 4 to 6 inches thereby providing a broad attachment base that allows for a reduction in the number of joiner plates or hangers for a given length of panel, thereby requiring less labor and installation time. The 3.5 to 5.5 inch space between the legs 20 creates a wide point at attachment, keeping lap panel attachment away from edges, and eliminating cracking of corners. In other embodiments the space is 3 to 6 inches between the legs 20.

Figure 3:
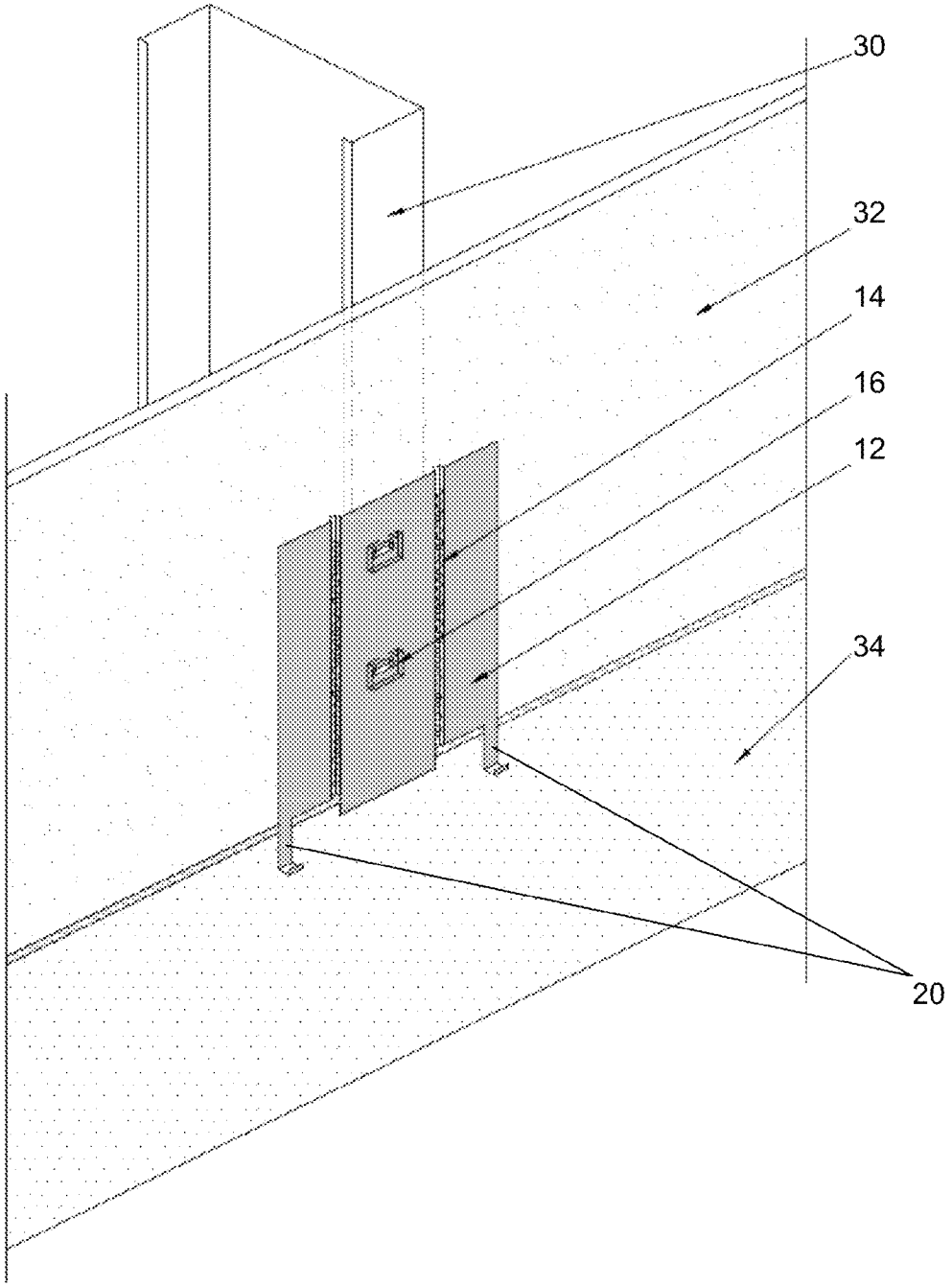
FIG. 3 is a perspective view of the embodiment of the joiner plate of FIG. 1 that is attached to a stud through a sheet of sheathing material.

FIG. 3 is a perspective view of the embodiment of the joiner plate 10 of FIG. 1 that is attached to a stud 30 through a sheet of sheathing material 32 such as gypsum with a fiber cement siding 34. Additional siding 34 may be inserted into legs 20. The color of the joiner plate 10 may match the color of the siding 34 if painted.

Figure 4:
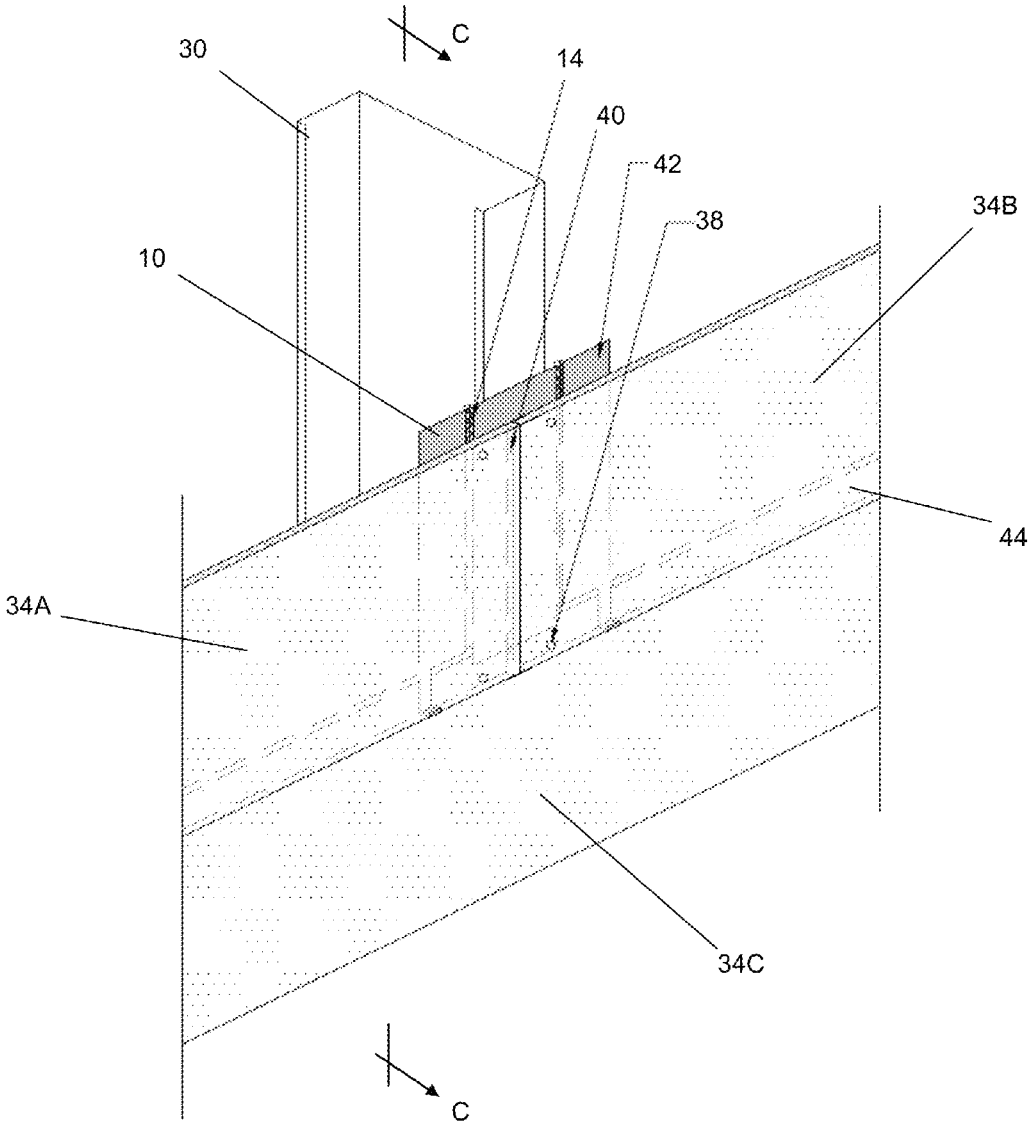
FIG. 4 is a perspective view of the embodiment of the joiner plate of FIG. 1 that is attached to directly to a stud.

FIG. 4 is a perspective view of the embodiment of the joiner plate 10 of FIG. 1 that is attached to directly to a stud 30 with siding 34 arranged in an over lapping fashion (lap siding) with a butt joint 40 between the span of the joiner plate 10 separating siding pieces 34A and 34B. It is appreciated that other joint types are also operative herein and these other joint types illustratively include rabbet joints, miter joints, splice joints, spline joints and dovetail joints. Siding pieces 34A and 34B overlaps siding strip 34C in region 44, with siding pieces 34A and 34B resting in legs 20 of the joiner plate 10. Panel attachment holes 38 accommodate a fastener to secure the siding panel to the plate 10, such as a thru panel #10 type fastener. As shown the joiner plate 10 optionally may extend beyond the top of a panel the joiner plate 10 is supporting as shown as region 42. FIG. 5 is a sectional view of the embodiment of the joiner plate of FIG. 4 along line C-C showing pancake head fasteners 36 securing the plate 10 to the stud 30.

Figure 6:
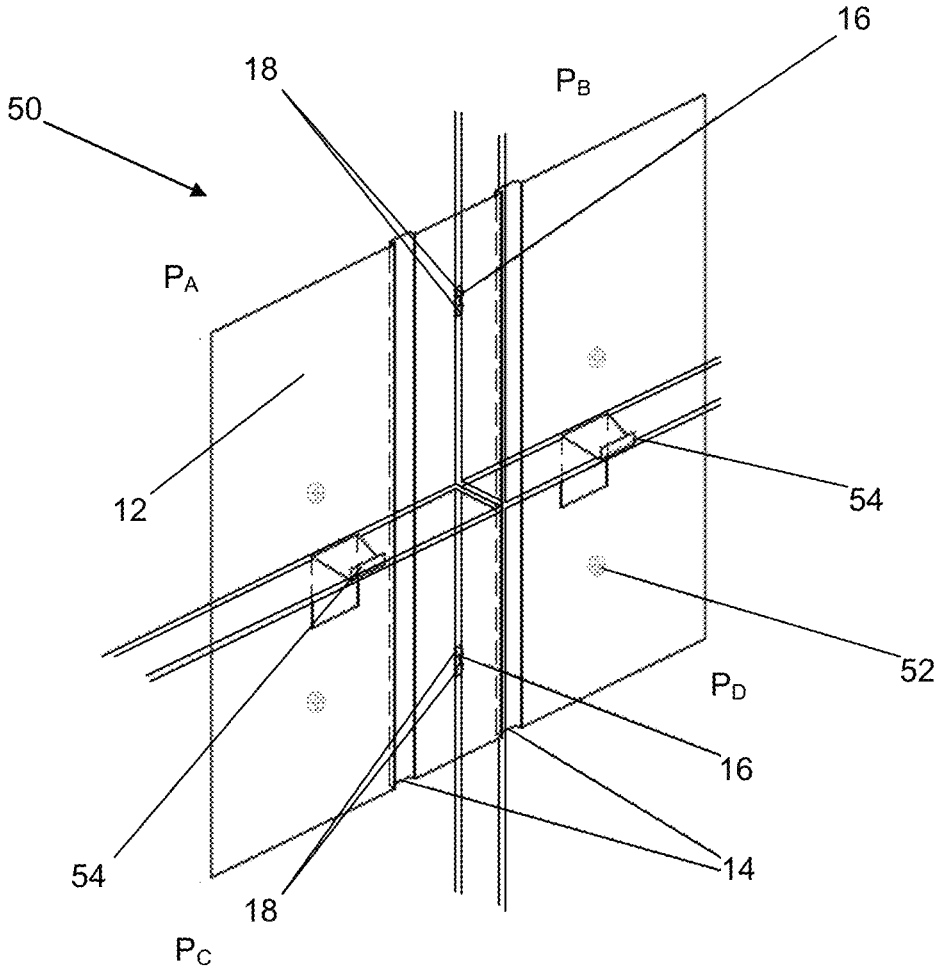
FIG. 6 is a perspective view of an additional embodiment of the inventive joiner plate.

FIG. 6 is a perspective view of an additional embodiment of the inventive joiner plate for securing four corners from four independent panels $P_A$, $P_B$, $P_C$, $P_D$ (shown in a transparent outline) in a non-overlapping arrangement. The joiner plate 50 is typically formed from a planar sheet composed of metal, alloys, plastic, or other composite materials. In an embodiment the joiner plate 50 is 16-26 gauge, G-90 galvanized metal or 16-26 gauge galvanized with paintgrip or bonderized coating. The joiner plate 50 has a flat face 12 in which channels 14 for holding an optional sealant or an adhesive based sealant are formed. Stud mounting holes 16 are pressed into the flat face 12 with the excess material forming vertical indent tabs in the form of control drive fins 18. The control drive fins 18 are adjustable to create planar conditions for attaching panels in the event the studs are uneven. In an installation, as a screw is driven into the flat face 12 (see FIG. 5), the control drive fins determine how tight the joiner plate 50 is held to the stud (not shown). In an embodiment, the control drive 18 are a quarter of an inch (0.25 inch) length, thereby providing the ability to adjust up to 0.25 inch for correcting for the relative planarity between the studs. In an embodiment number ten or twelve diameter pancake head screws countersunk and flush with the vertical flat face 12 of the joiner plate 50, where the head of the screws 36 have approximately the same outer diameter as the mounting holes 16. The pancake head screws provide a minimum withdrawal resistance in 33 KSI in galvanized steel of 225lbf. Thru-panel fasteners 52 may also be (#10) pancake head screws that secure the four corners of the four independent panels $P_A$, $P_B$, $P_C$, $P_D$ to the joiner plate 50. Punch tabs 54 are formed from the flat face 12 of joiner plate 50. The punch tabs 54 act as positioning retaining shelves for holding panels $P_A$, $P_B$ prior to their securement with thru-panel fasteners 52. In an embodiment the joiner plate may be a square with 6 inch sides.

Figure 7:
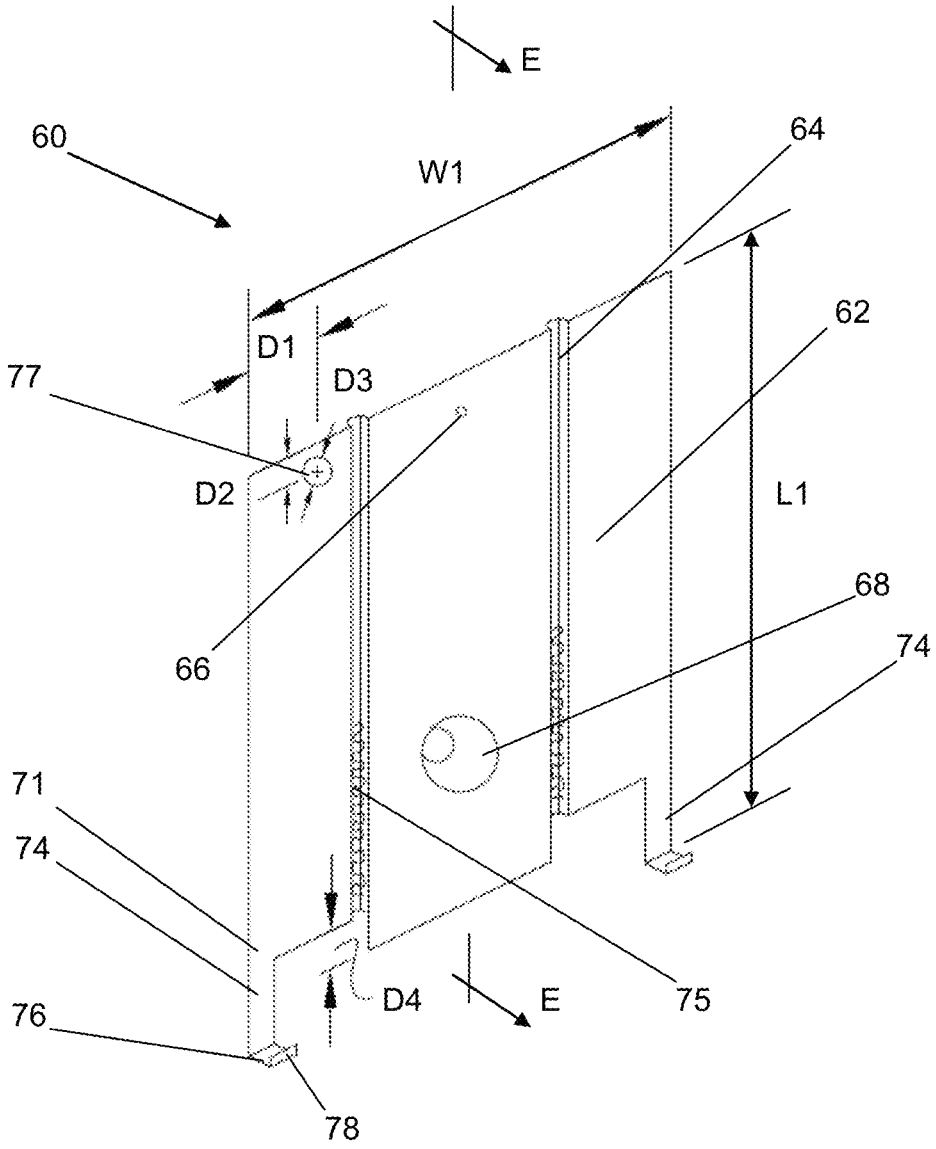
FIG. 7 is a perspective view of an embodiment of a joiner plate or clip for fiber cement (FC) cladding or panels.

An inventive fiber cement (FC) fiber cement joiner plate or clip is depicted generally at 60 in FIG. 7. The joiner plate and clip 60 is typically formed from a planar sheet composed of metal, alloys, plastic, or other composite materials. In an embodiment the joiner plate and clip 60 is 16-26 gauge in thickness, G-90 galvanized or GALVALUME® metal or galvanized paintgrip/bonderized. The joiner plate and clip 60 has a flat face 62 in which channels 64 for holding an optional sealant or an adhesive based sealant 75 are formed. Mounting holes 66 and 68 are pressed into the flat face 62. Mounting hole 66 is an aperture positioned in the upper center lime portion of the joiner and clip 60, while mounting hole 68 is a circular countersunk indent with a predrilled hole or aperture.

Figure 9:
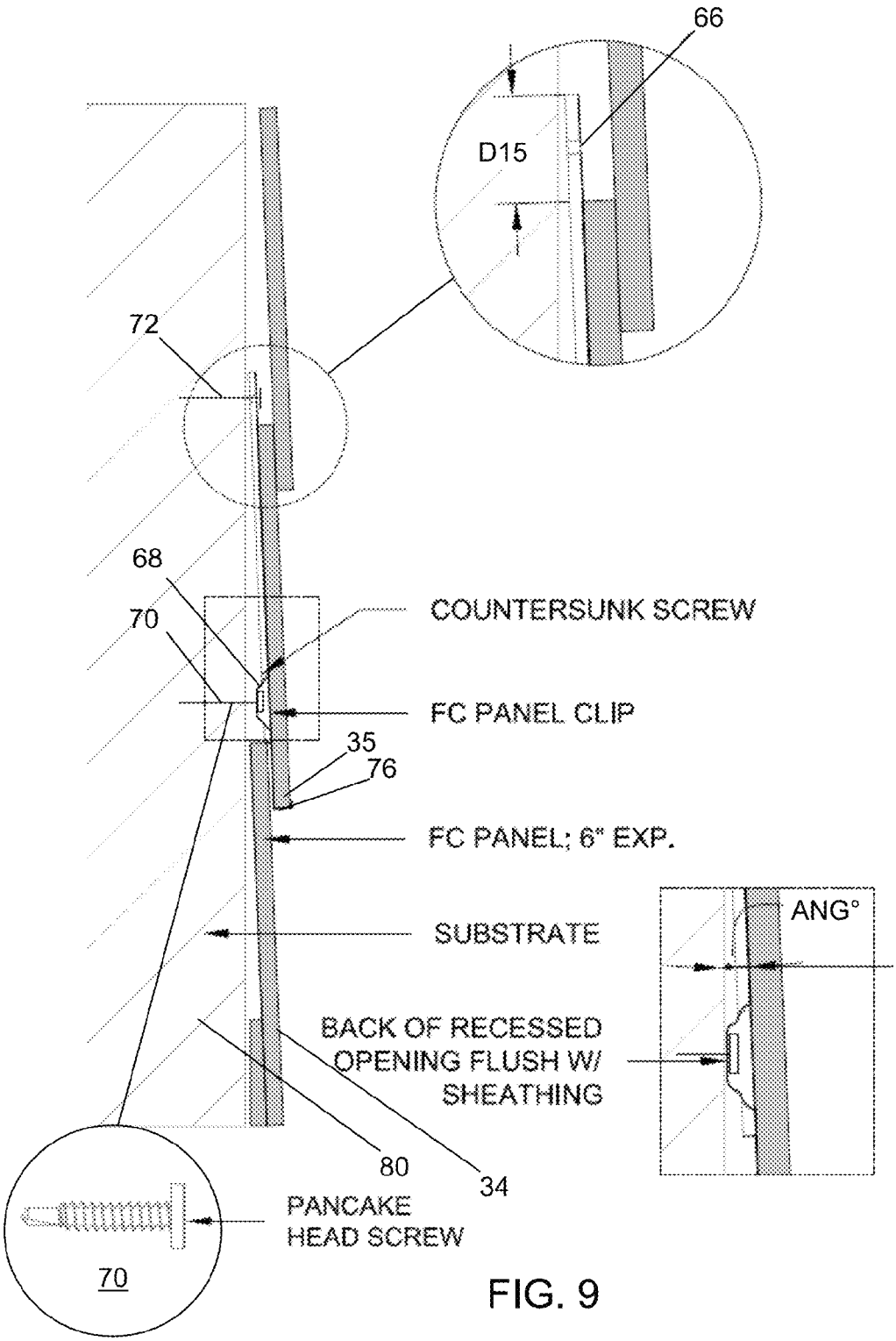
FIG. 9 is a perspective view of the embodiment of the joiner plate or clip of FIG. 7 that is attached to a substrate to support fiber cement panels.

As shown in FIG. 9, a countersunk screw 70 may be pre-set in the circular countersunk indent 68, and screw 72 is inserted through aperture 66. In an embodiment number ten (#10) pancake head screws are countersunk and flush with the vertical flat face 62 of the joiner plate and clip 60, where the head of the screws 70 and 72 have approximately the same outer diameter. The (#10 or #12) pancake head screws provide a minimum withdrawal resistance in 33 KSI 24 ga. galvanized steel of not less than 225 lbf. A pancake screw does not interfere with succeeding panels.

Figure 8:
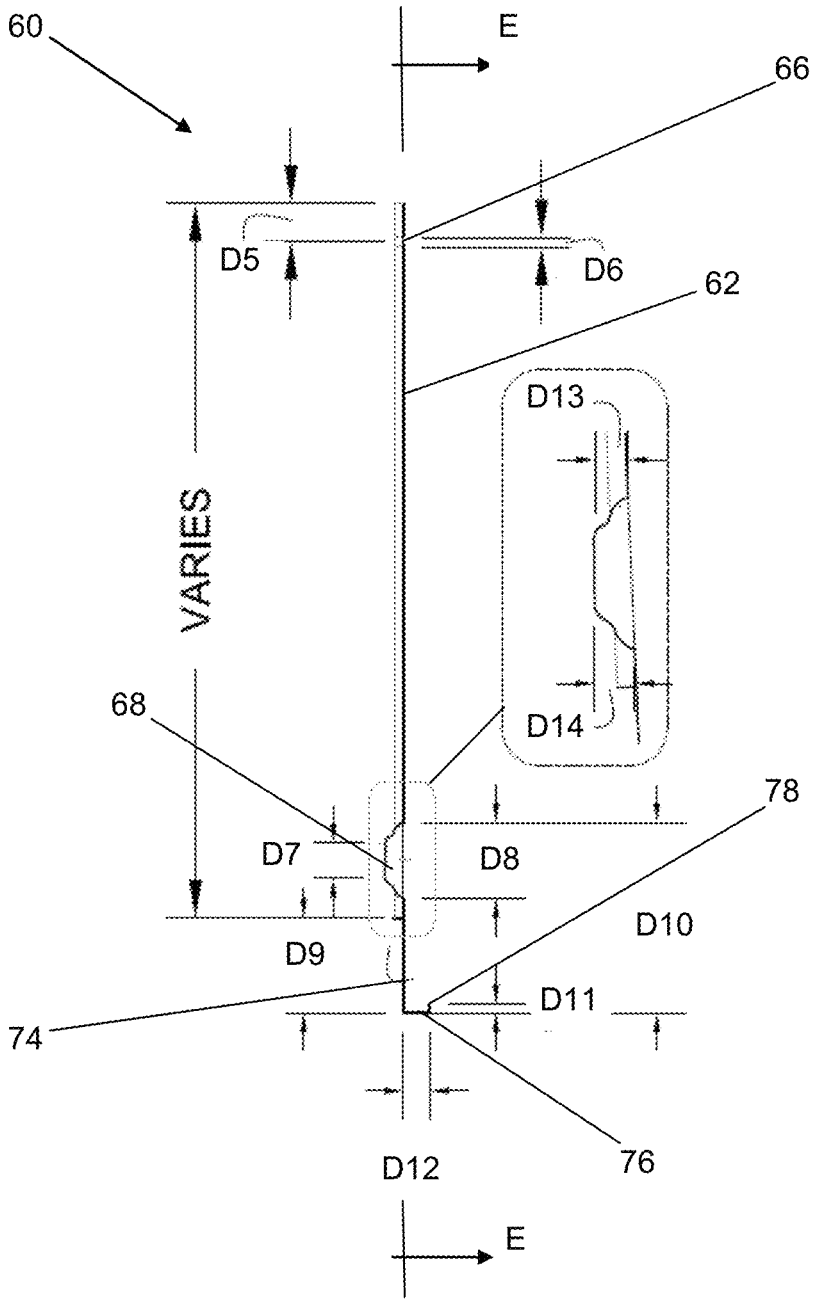
FIG. 8 is a schematic diagram illustrating a cross sectional view of the embodiment of the joiner plate or clip of FIG. 7 along line E-E.

Continuing with FIGS. 7 and 8, the lower portion 71 of the joiner plate and clip 60 has a pair of legs 74 extending downward on the right and left sides of the joiner plate and clip 60. A right angled segment 76 or foot extends from the leg 74 and terminates with upward segment or lip 78 that acts as a retaining shelf for a panel, such as a fiber cement (FC) panel. Thus the joiner plate and clip 60 supports a panel with both concealed screws 70 and 72, and the retaining shelf acting as a "turn-up" support clip at the base of the joiner plate and clip 60. In an embodiment, the center of the clip extends down one half inch (0.50") to form a drip lip. This drip lip aids with alignment and panel support acts as a drip over the panel below. The overall width (W1) of the joiner plate and clip 60 as shown in FIG. 7 may range between 4 to 6 inches thereby providing a broad attachment base that allows for a reduction in the number of joiner plates or hangers for a given length of panel, thereby requiring less labor and installation time. In an embodiment W1 is five inches. The 3.5 to 5.5 inch space between the legs 74 creates a wide point at attachment, keeping lap panel attachment away from edges, and eliminating cracking of corners especially for FC siding. Carrying hook hole 77 is provided for ease of transport by a workman during an installation of panels at a worksite. In an embodiment hole 77 has a three eights inch (⅜") inch diameter and is positioned one inch (1.0") D1 in from the upper left corner and centered three eights inch (⅜") D2 down.

FIG. 9 is a perspective view of the embodiment of the joiner plate and clip 60 of FIG. 7 that is attached to a substrate 80 and supports siding sheets such as fiber cement siding panel 34 that has a bottom portion 35 that is held under the right angled segment 76 or foot that extends from the leg 74 and terminates with upward segment or lip 78. The color of the joiner plate and clip 60 may match the color of the siding 34 if painted. Circular countersunk indent 68 provides a standoff from the substrate 80 that creates an angled placement (ANG°) of the siding, and for an overlapping placement of the siding 34. In an embodiment there is a two degree angle (ANG°) between the substrate 80 and the back of the clip 60. In an embodiment, the circular countersunk indent 68 is one inch wide punched area with an eighth (⅛") of inch drilled hole. The length of the vertical leg 74 and overall length (L1) varies depending on the required exposure of the panel. In an embodiment the clip extends one inch above the panel that the clip supports, as shown as dimension D15 in detail A of FIG. 9.

Figure 10:
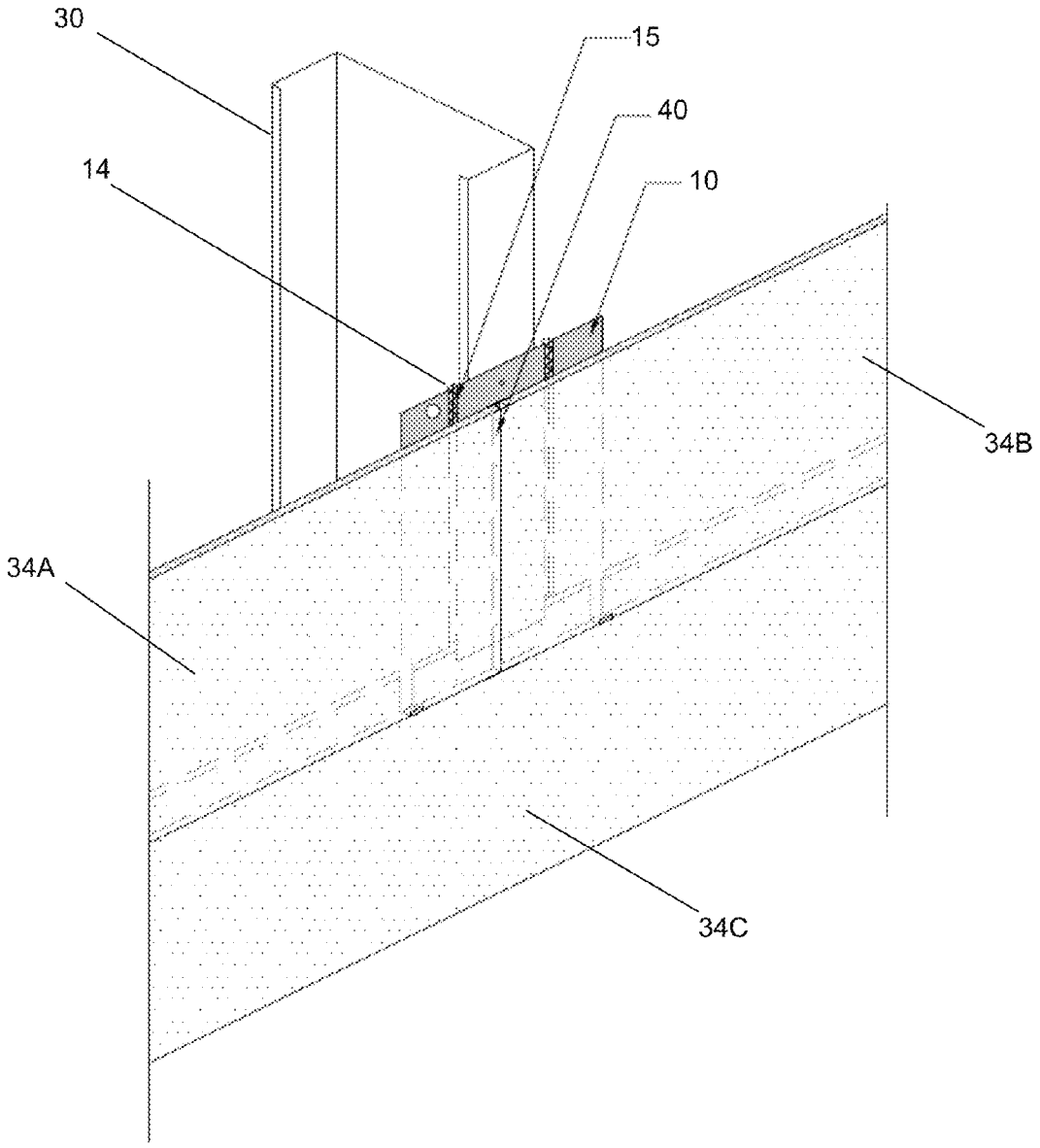
FIG. 10 is a perspective view of the embodiment of the joiner plate of FIG. 1 that is attached directly to a stud and the panels are secured to the joiner plate with an adhesive without the use of thru panel fasteners.

FIG. 10 is a perspective view of the embodiment of the joiner plate 10 of FIG. 1 that is attached directly to a stud 30 and the panels 34A, 34B, and 34C are secured to the joiner plate with an adhesive without the use of thru panel fasteners. No fasteners are required through the cladding or siding at any point, thereby guarantying the integrity of brittle panel materials. The cladding or siding is secured by support of the tabs below, compression of the flashing tab and the sealant 15 applied in the sealant channels 14.

Any patents or publications mentioned in this specification are herein incorporated by reference to the same extent as if each individual publication was specifically and individually indicated to be incorporated by reference.

The foregoing description is illustrative of particular embodiments of the invention, but is not meant to be a limitation upon the practice thereof.

The invention claimed is:

1. A joiner clip for securing panels to a substrate comprising:

a planar sheet of material, having a bottom portion, the bottom portion having outer edges;

a pair of legs extending downward from the outer edges of the bottom portion of said planar sheet, said pair of legs terminating in a retaining shelf clip adapted to hold a bottom edge of an inserted panel;

a first mounting hole in a countersunk indent of said planar sheet that offsets the joiner clip from the substrate;

a second mounting hole in said planar sheet; said first mounting hole and said second mounting hole sized to accommodate fasteners for attaching the joiner clip to the substrate; and one or more control drive fins on a back side of said planar sheet for compensation for portions of the substrate that are out of plane.

2. The joiner clip of claim 1 further comprising one or more channels for accommodating a sealant bead.

3. The joiner clip of claim 2 wherein said pair of legs is integral with said planar sheet.

4. The joiner clip of claim 1 wherein said planar sheet of material is a metal, alloy, plastic, or fiber reinforced resin.

5. The joiner clip of claim 1 wherein said countersunk indent provides a standoff from said substrate that creates an angled placement of the inserted panel.

6. The joiner clip of claim 1 wherein said legs are spaced between 3.5 to 5.5 inches apart.

7. The joiner clip of claim 1 wherein said fastener is a pancake head screw that is countersunk and flush with a vertical flat face of said planar sheet, a head of the pancake head screw with a diameter that is larger than a lower portion of a chamfer of a countersink hole, and where the diameter of the head is less than the diameter of an upper portion of the chamfer of the countersink hole of said mounting holes.

8. The joiner clip of claim 1 wherein the inserted panel is fiber cement.

9. The joiner clip of claim 1 wherein said planar sheet is 16-26 gauge galvanized metal.

10. The joiner clip of claim 1 wherein said planar sheet is 55% Aluminum-Zinc alloy coated sheet steel.

11. The joiner clip of claim 1 wherein said planar sheet is galvanized paintgrip or galvanized bonderized.

12. The joiner clip of claim 2 wherein said planar sheet acts as a waterproofing flashing at a joint with said inserted panel forms a fabric flashing or a flat metal plate with said one or more channels for accommodating said sealant bead.

13. The joiner clip of claim 1 wherein said joiner clip is installed at both a top and a bottom of an inserted panel to eliminate the need for through-fastening of the inserted panel to the substrate.

14. The joiner clip of claim 1 wherein the substrate is a stud.

15. A construction unit comprising:

a vertical stud substrate;

a joiner clip for securing panels to the substrate comprising: a planar sheet of material, having a bottom portion, the bottom portion having outer edges; a pair of legs extending downward from the outer edges of the bottom portion of said planar sheet, said pair of legs terminating in a retaining shelf clip; a first mounting hole in a countersunk indent of said planar sheet that offsets the joiner clip from the substrate; a second mounting hole in said planar sheet; said first mounting hole and said second mounting hole sized to accommodate fasteners for attaching the joiner clip to the substrate; and one or more control drive fins on a back side of said planar sheet for compensation for portions of the substrate that are out of plane; and an inserted panel supported by at least one of said pair of legs.

16. The unit of claim 15 further comprising a fastener extending through said inserted panel to said joiner clip.

17. The unit of claim 15 wherein said inserted panel is supported by only a first leg of said pair of legs and further comprising a second inserted panel forming a joint with said inserted panel and supported on a second leg of said pair of legs.

18. The unit of claim 15 further comprising a siding strip secured to said substrate beneath said inserted panel.

* * * * *